US007417516B2

(12) United States Patent
Singh

(10) Patent No.: US 7,417,516 B2
(45) Date of Patent: Aug. 26, 2008

(54) MONOLITHIC MICROWAVE INTEGRATED CIRCUIT PROVIDING POWER DIVIDING AND POWER MONITORING FUNCTIONALITY

(75) Inventor: Donald R. Singh, Apple Valley, MN (US)

(73) Assignee: Honeywell International Inc., Morristown, NJ (US)

( * ) Notice: Subject to any disclaimer, the term of this patent is extended or adjusted under 35 U.S.C. 154(b) by 156 days.

(21) Appl. No.: 11/272,650

(22) Filed: Nov. 14, 2005

(65) Prior Publication Data

US 2007/0109070 A1 May 17, 2007

(51) Int. Cl.
*H01P 5/12* (2006.01)
*H01P 5/22* (2006.01)

(52) U.S. Cl. ..... 333/109; 333/129

(58) Field of Classification Search ..... 333/109, 333/110, 112, 118, 120, 129, 132
See application file for complete search history.

(56) References Cited

U.S. PATENT DOCUMENTS 6,677,893 B2 * 1/2004 Rideout et al. ..... 342/353
2005/0068223 A1 * 3/2005 Vavik ..... 342/51

OTHER PUBLICATIONS

H. Wang et al., "A monolithic W-band Preamplified Diode Detector", Microwave Symposium Digest, IEEE MTT-S International, vol. 1, pp. 365-368, Jun. 1993.

A. Räisänen et al., "Radio Engineering for Wireless Communication and Sensor Applications", Chapters 6 and 8, pp. 115-140 and pp. 171-203, Artech House, 2003.

S. Kayali, "GaAs MMIC Reliability Assurance Guideline for Space Applications", JPL Publication 96-25, Dec. 15, 1996.

"The Zero Bias Schottky Diode Detector at Temperature Extremes—Problems and Solutions", Aplication Note 1090 from Agilent Technologies, 1999.

"Directional Couplers: Lumped Element and Stripline 100 kHz to 65 GHz General Information", Product Information from Merrimac, Mar. 21, 1996.

"Agilent GaAs MMIC TWA Users Guide", Application Note #56, Rev. A, from Agilent Technlogies, Jan. 2001.

"Lange Coupler Set", Advance Product Information from TriQuint Semiconductor, Apr. 7, 2003.

J.E. Penn, "A Broadband, Four-Bit, Ka-Band MMIC Phase Shifter", Microwave Journal, Dec. 2001.

A. Callender, "The Race is On for Packaged MMICs", May 2002.

B. Rivera et al., "Design and Layout of Schottky Diodes in a Standard CMOS Process", appears in Semiconductor Device Reserch Symposium, 2001 International, pp. 79-82, Meeting Date Dec. 5, 2001-Dec. 7, 2001, Publication Date: 2001.

".25μm mmW pHEMT 2MI", Process Data Sheet from TriQuint Semiconductor, Sep. 24, 2002.

* cited by examiner

*Primary Examiner*—Dean O Takaoka
(74) *Attorney, Agent, or Firm*—McDonnell Boehnen Hulbert & Berghoff LLP

(57) ABSTRACT

A monolithic integrated circuit for performing power dividing and power monitoring functions is disclosed. The monolithic integrated circuit includes a power dividing portion for dividing radio frequency (RF) signal power and a power monitoring portion for monitoring the RF signal power. In one example, the monolithic integrated circuit is a microwave monolithic integrated circuit (MMIC) for use in high-frequency applications within microwave and millimeter-wave frequency range.

18 Claims, 6 Drawing Sheets

MONOLITHIC MICROWAVE INTEGRATED CIRCUIT PROVIDING POWER DIVIDING AND POWER MONITORING FUNCTIONALITY

GOVERNMENT RIGHTS

The United States Government has acquired certain rights in this invention pursuant to Contract No. HP100786M8S (Subcontract No. DL-H-543145) awarded by the United States Air Force.

BACKGROUND

1. Field of the Invention

The present invention relates to integrated circuits and, more particularly, to microwave monolithic integrated circuits (MMICs) for use in high-frequency applications, such as those in the microwave and millimeter-wave frequency regions.

2. Description of Related Art

Integrated circuits have gained widespread use in many electronic applications. In early hybrid integrated circuits, active elements (such as diodes and transistors) and passive elements (such as resistors, capacitors, and inductors) were typically discrete components mounted (e.g., soldered or bonded) to a dielectric slab or substrate. In contrast, in a monolithic integrated circuit (or "monolithic circuit"), circuit components including active and passive elements are integrated monolithically, i.e., formed directly on a common semiconductor substrate.

Typically, depending on the operating frequency, monolithic integrated circuits may be formed on different types of substrates. As an example, the monolithic integrated circuits operating up to 1-2 GHz may be fabricated on silicon (Si) substrate. At higher operating frequencies, such as microwave and millimeter-wave frequencies (approximately between 1-300 GHz), the substrate is usually gallium arsenide (GaAs) and these circuits are commonly referred to as monolithic microwave integrated circuits, or MMICs. Some of the advantages of MMICs include their small sizes, the inclusion of multiple functions (e.g., radio frequency (RF) and logic) on a single semiconductor chip, and a wider frequency-bandwidth performance that is often difficult to achieve with discrete devices due to bandwidth-limiting parasitics associated with discrete-device packaging.

Typically, RF signals at microwave and millimeter-wave frequencies can easily penetrate harsh environments such as dust, smoke, and snow, and are very attractive due to their high spatial resolution, resulting in a compact chip size and small antenna dimension. As such, MMICs find use in various commercial, military, and space applications. For example, in addition to the traditional use in radars, microwave and millimeter wave techniques are finding applications in such diverse areas as forward-looking automotive radar, Synthetic Vision Systems (SVS) for aircraft landing, Concealed Weapon Detection (CWD) systems, industrial sensors and accelerometers.

Typically these systems employ a stable transmitter and highly sensitive receiver incorporating a mixer and a local oscillator. However, increasing use of microwave and millimeter-wave frequency bands for communication, radar and measurements have created the need for more sophisticated methods for controlling the frequency, power and phase of these sources of radiation. For example, coherent radar systems have for years relied on phase-locked or injection-locked transmitters as well as phase-locked local oscillator for receivers. In addition to down-converters, IF amplifiers, and phase detectors, typically these techniques use a directional coupler and a power divider to meet the required specifications.

In general, the coupler and power divider are either coaxial/waveguide or fabricated using hybrid microstrip technology. The latter does generally reduce the overall component size, but it still does not lead to a compact, low cost design. Moreover, many newer applications require RF power monitoring capability for accurate control of output power.

Thus, there is a general need for a MMIC, which incorporates the functions of power distribution and power monitoring over a large bandwidth in the microwave and millimeter-wave frequency range.

SUMMARY OF THE INVENTION

The present invention provides a monolithic integrated circuit for performing broadband power distribution and power detection, such as within microwave and millimeter-wave frequency range.

More particularly, the circuit includes a power monitoring portion for monitoring an RF signal power and a power dividing portion for dividing the RF signal power, where the power monitoring portion and the power dividing portion are integrated monolithically. In an illustrative embodiment, the circuit is a MMIC that may be fabricated on a single semiconductor chip using, for example, a pseudomorphic high electron mobility transistor (pHEMT)-based process. Preferably, the MMIC will be operable within microwave and/or millimeter-wave frequency band. For example, in one disclosed embodiment, the MMIC may be optimized to operate within a typical broadband frequency range, such as 14-20 GHz or more.

This as well as other aspects of the present invention will become apparent to those of ordinary skill in the art by reading the following detailed description, with appropriate reference to the accompanying drawings.

BRIEF DESCRIPTION OF THE DRAWINGS

Presently preferred embodiments are described below in conjunction with the appended drawing figures, wherein like reference numerals refer to like elements in the various figures, and wherein.

DETAILED DESCRIPTION OF PRESENTLY DISCLOSED EMBODIMENTS

1. General Overview

Figure 1A:
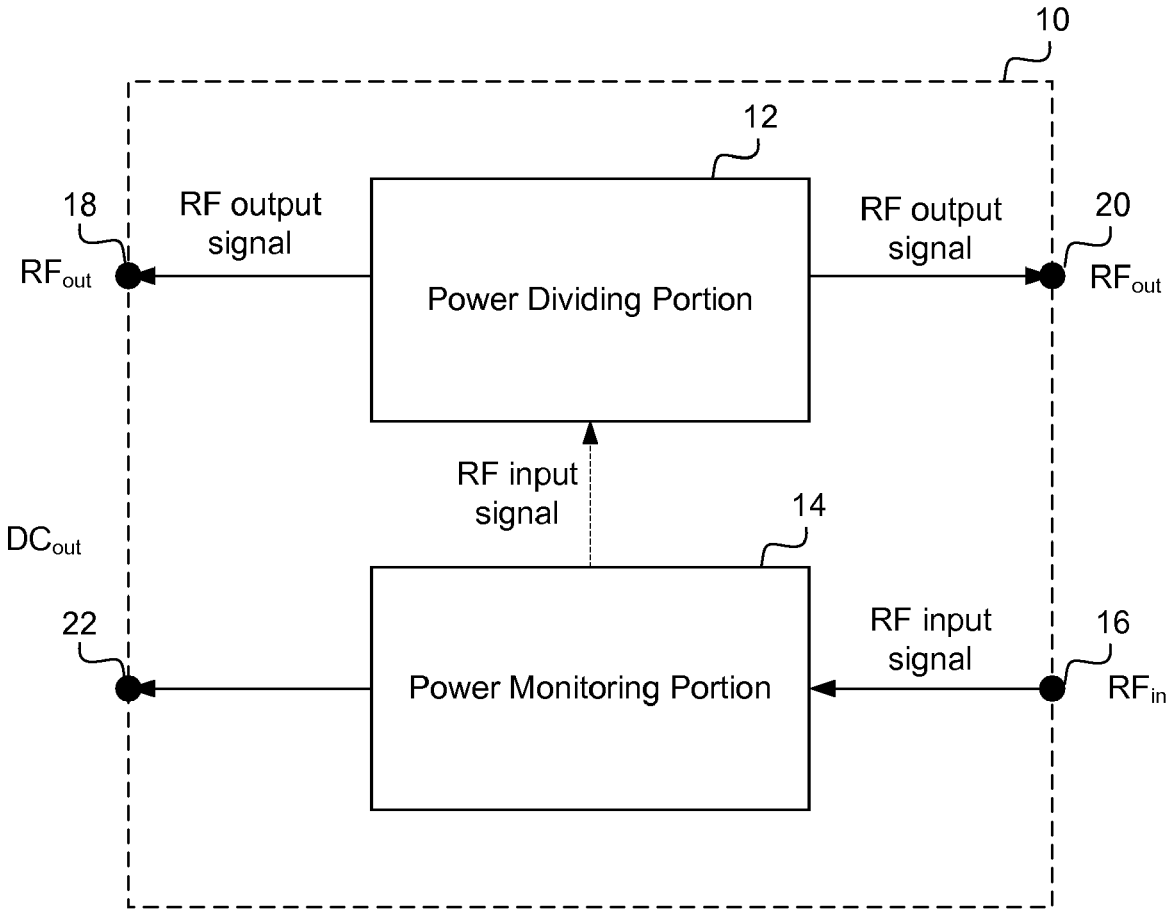
FIG. 1A is a block diagram of a monolithic integrated circuit according to an embodiment of the invention.

FIG. 1A illustrates a simplified block diagram of a monolithic integrated circuit 10 (hereinafter referred to as "monolithic circuit 10") in accordance with one example embodiment of the present invention. As illustrated in FIG. 1A, monolithic circuit 10 comprises a power dividing portion 12 and a power monitoring portion 14 that are integrated monolithically, i.e., formed directly on a common semiconductor substrate, such as on a single semiconductor chip. In a preferred embodiment, monolithic circuit 10 is a MMIC adapted for broadband high-frequency operation, particularly within microwave and/or millimeter-wave regions of the radio frequency spectrum (e.g., above 15 GHz). As shown in FIG. 1A, an RF input signal may be supplied to monolithic circuit 10 via an RF input ($RF_{IN}$) 16. Further, in the example embodiment of FIG. 1A, monolithic circuit 10 provides two RF outputs ($RF_{OUT}$) 18 and 20 and a DC (direct current) output ($DC_{OUT}$) 22.

It should be understood, however, the circuit arrangement of FIG. 1A is provided for illustrative purposes only and variations are possible. As one example, monolithic circuit 10 may include additional circuit block(s) for providing other function(s) in addition to those of power diving and power monitoring. As another example, circuit 10 may include a greater number of signal inputs and/or outputs than shown. Other circuit variations may also be possible.

In operation, when an RF input signal is applied at RF input 16, the RF input signal may be provided via power monitoring portion 14 to power dividing portion 12 that will divide (or distribute) the RF input signal power between multiple (i.e., two or more) RF outputs. In one disclosed embodiment, power dividing portion 12 divides the RF input signal power two-ways, i.e., it splits the RF input signal into two RF outputs 18 and 20. More specifically, power dividing portion 12 will divide the RF input signal power substantially in half, such as to produce two RF output signals of approximately equal amplitude. In particular, each RF output signal will have a power level of approximately 3 dB down from the input signal power level (i.e., a ratio of the output signal to the input signal is approximately one half). In other embodiments, however, it may be possible to distribute the RF input power/signal between more than two RF output ports.

In turn, power monitoring portion 14 may operate to concurrently monitor the RF input signal power, i.e., power monitoring section 14 may sense/measure the RF input signal power and produce an output signal representative of the RF input signal power. Although not shown in detail in FIG. 1A, in order to provide power monitoring functionality, power monitoring portion 14 may be configured to couple off a portion of the RF input signal applied at RF input 16. The coupled portion of the RF input signal may be then provided to an RF detector that can transform the signal into an observable form. In particular, the detector may detect the RF power in the coupled portion of the RF input signal and produce an output voltage representative of the signal power. The output voltage may be then monitored at DC output 22.

Figure 1B:
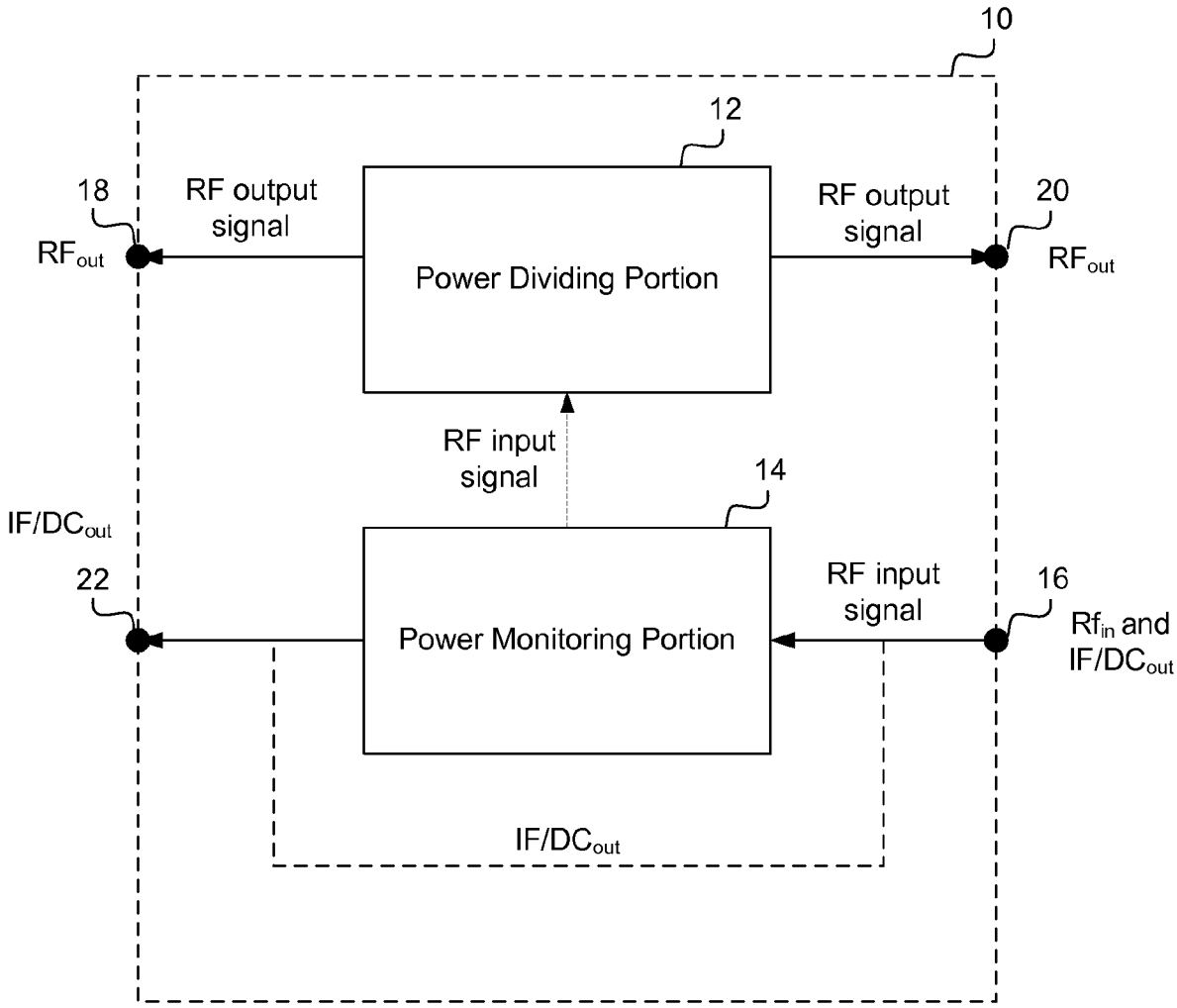
FIG. 1B is another block diagram of the monolithic integrated circuit of FIG. 1A.

FIG. 1B illustrates an additional feature that may be included as part of monolithic circuit 10 shown in FIG. 1A. More particularly, as illustrated in FIG. 1B, monolithic circuit 10 may be configured such that the output voltage appearing at DC output 22 may be coupled to RF input 16. As such, the output voltage response of power monitoring portion 14 can be monitored via RF input 16. Advantageously, a number of external connections to monolithic circuit 10 may be reduced (e.g., when connecting the monolithic circuit into a larger RF system, such as a transmitter/receiver system).

Further, in some embodiments, the RF input signal may be a continuous wave (CW) RF signal, while in others, it may be a modulated carrier signal, such as an amplitude-modulated (AM) signal. To indicate the ability of power monitoring portion 14 to detect the amplitude of signal components associated with both CW and modulated RF signals, DC output 22 may alternatively be denoted as "IF/DC output ($IF/DC_{OUT}$) 22" (as shown in FIG. 1B), where the "IF output" refers to an output voltage corresponding to an amplitude of a modulated RF signal.

2. Circuit Details

Figure 2:
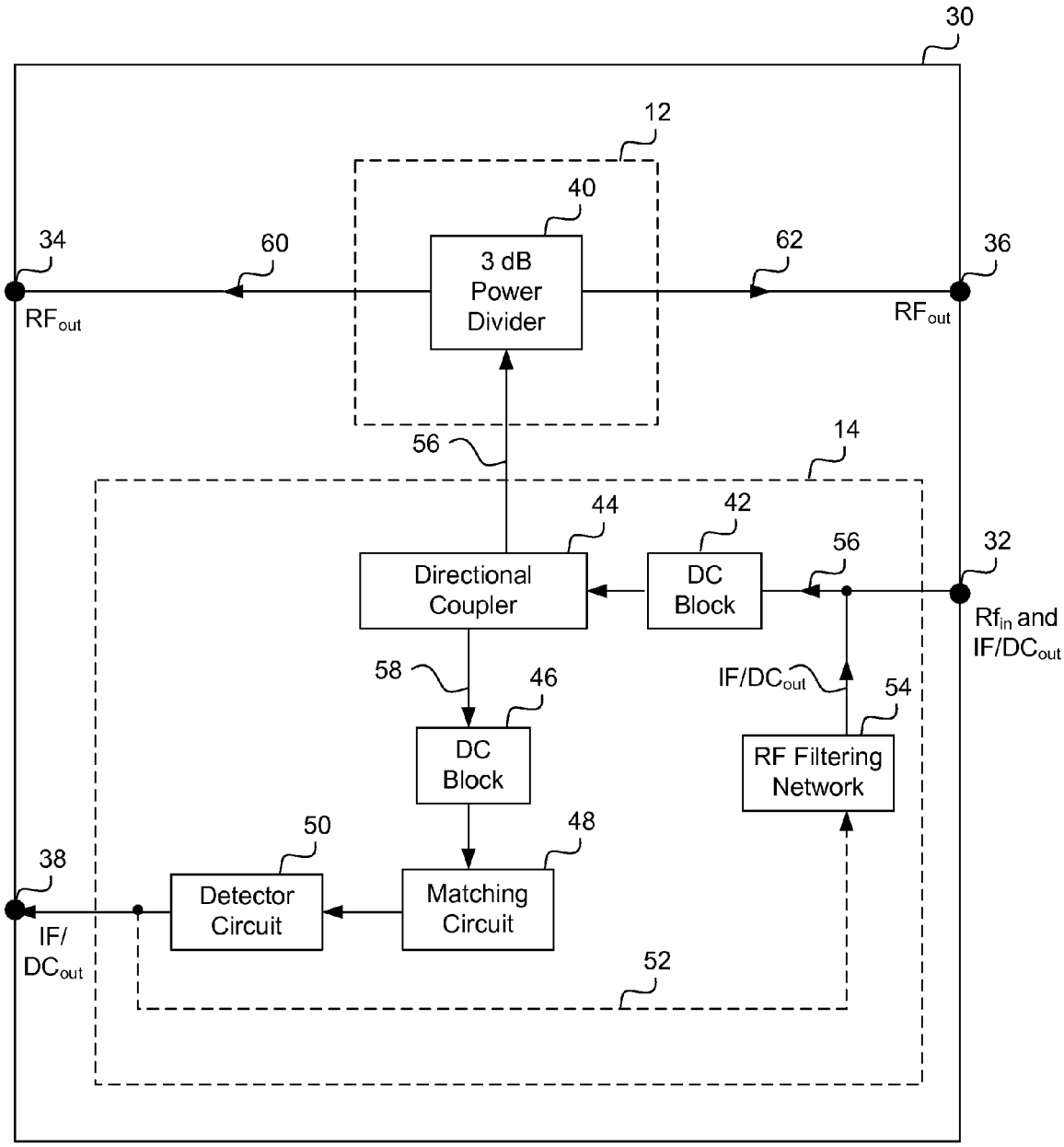
FIG. 2 is a block diagram of a representative MMIC.

FIG. 2 illustrates a more detailed block diagram of a representative MMIC 30 including power monitoring portion 12 and power dividing portion 14.

As illustrated in FIG. 2, an RF input signal 56 may be supplied to MMIC 30 via an RF input ($RF_{IN}$) port 32. MMIC 30 also includes two RF output ($RF_{OUT}$) ports 34 and 36 and an IF/DC output ($IF/DC_{OUT}$) port 38. Further, power dividing portion 12 may include a 3 dB power divider 40, while power monitoring portion 14 may include a DC block 42, a directional coupler 44, a DC block 46, a matching circuit 48, a detector circuit 50, a connection 52, and an RF filtering network 54.

In practice, when RF input signal 56 is applied at RF input port 32, the RF input signal will be provided to directional coupler 44 via DC block 42 that functions to pass RF signal energy while blocking DC voltages. Although not shown in detail in FIG. 2, a directional coupler, such a coupler 44, is generally a multiple-port passive element in which two transmission lines pass sufficiently close to each other such that electromagnetic energy propagating in one line (typically referred to as the "main line") couples to the other line. Directional couplers are typically described in terms of a coupling parameter, which specifies (in dB) the ratio of the coupled signal power to the input signal power (i.e., the ratio of the signal power appearing at the coupled port to the signal power at the input port, e.g., 10 dB, 20 dB, etc.). Directional couplers are commonly used in RF power measurements due to their ability to sample signal power.

Provided that insertion loss (or "main line" loss) of directional coupler 44 is fairly low relative to a power level of RF input signal 56, the RF input signal flowing through the directional coupler will substantially pass to the input of 3 dB power divider 40. In turn, a coupled portion of the RF signal input signal (herein denoted as an RF coupled signal 58) will be provided as an input to matching circuit 48 and subsequently to RF detector circuit 50. When RF coupled signal 58 is provided into (matched) detector circuit 50, the detector circuit will function to detect signal power of the RF coupled signal and responsively produce a corresponding voltage at IF/DC output port 38.

Note that, depending on the impedance characteristics of the RF detector circuit, matching circuit 48 will usually be necessary to match the detector circuit input impedance over a desired frequency range to the rest of the circuit (e.g., an input transmission line having a characteristic impedance of 50 ohms). Impedance matching is desirable in order to get substantially all input signal power absorbed into the detector circuit for an accurate power measurement. Impedance mismatch may cause undesired signal reflections, thereby reducing the amount of RF signal power transferred to the detector circuit and affecting power measurement accuracy over the desired frequency range.

As noted above, RF input signal 56 will substantially pass via directional coupler 44 to the input of 3-dB power divider 40 that will divide the RF input signal into two RF output signals 60 and 62 having substantially equal power levels. The two RF output signals 60 and 62 are provided at RF output ports 34 and 36, respectively.

In one embodiment, 3-dB power divider 40 may be implemented with a 3-dB hybrid coupler, although other alternate power-divider structures may also be possible. As known in the art, 3-dB hybrid couplers (or "hybrids") are basically directional couplers with a 3 dB coupling and a phase difference between their output signals. Thus, a hybrid coupler normally splits an input signal into two output signals having substantially equal power levels, but separated by a phase difference. Two common types of hybrids are 3-dB 90- and 180-degree hybrids. Some known 90-degree hybrid couplers (also known as "quadrature" couplers) include a Lange coupler and a branchline coupler. An example of a 180-degree hybrid coupler is a ring coupler.

As further shown in FIG. 2, power monitoring portion 14 may include connection 52 coupling the output voltage at IF/DC output port 38 to RF input port 32 via RF filtering network 54. The RF filtering network preferably filters RF signal energy from coupling to IF/DC output port 38. At the same time, the DC signal present at IF/DC output port 38 can flow through connection 52 and RF filtering network 54 to RF input port 32. Advantageously, the IF/DC output voltage can be monitored via RF input port 32. This particular circuit feature may, for example, eliminate the need for a separate connection to IF/DC output port 38 during MMIC packaging stage.

Figure 3:
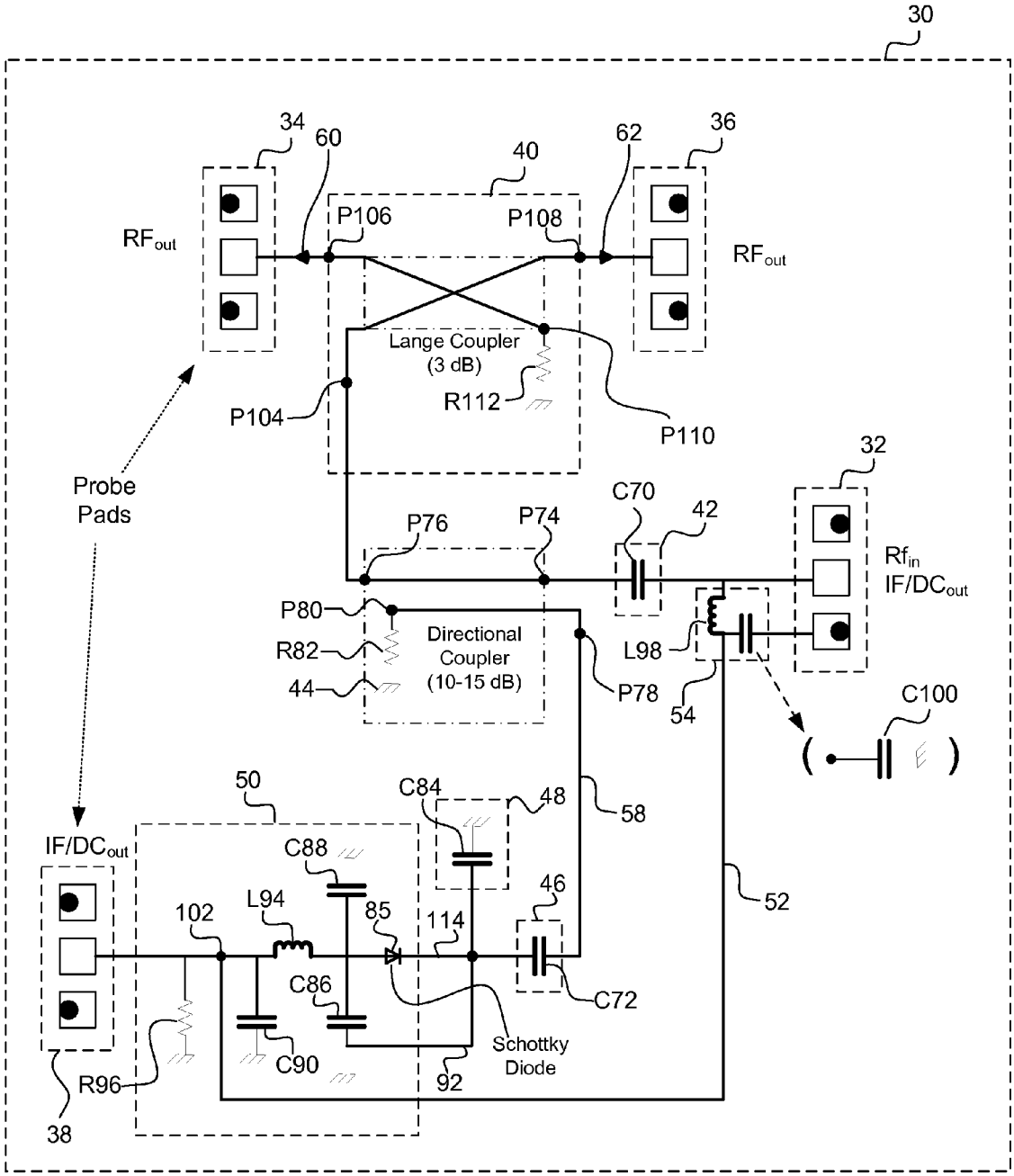
FIG. 3 is a general circuit diagram of the representative MMIC.

FIG. 3 illustrates a circuit diagram depicting MMIC 30 in greater detail. Note that various circuit components shown may be interconnected and/or constructed (e.g., couplers) by means of transmission lines, such as microstrip lines, having suitable characteristic impedance characteristics (e.g., 50 ohms or other, as appropriate).

As shown in FIG. 3, MMIC ports (i.e., RF input port 32, RF output ports 34 and 36, and IF/DC port 38) may include probing pads (or "footprints") that may be advantageously utilized for on-wafer RF/DC testing.

As shown in the example of FIG. 3, each of the probing pads may include a center conductive portion and a pair of additional ground pads (each shown in FIG. 3 as including a grounding via) that typically provide ground contacts for specialized probes used for chip testing. (Note: the probing pads are shown for purpose of example only and variations based on the type of probe used, desired RF characteristics, etc. may be possible). Further, the probing pads (particularly the conductive portions thereof) may also serve as bonding pads used for bonding a MMIC chip into an electrical system. In particular, the MMIC chip in a bare-die form may be placed onto a suitable carrier material and necessary RF/DC connections to the chip may be provided via the bonding pads.

DC block 42 may be implemented with a series capacitor C70 that has a low series reactance within frequency band of interest, such that it appears as an RF short circuit, while acting as an open circuit with respect to DC. Similarly, as shown, DC block 46 includes a series capacitor C72. Typically, a DC blocking capacitor is selected to have a value large enough to appear as an RF short circuit at the lowest desired operating frequency.

Further, FIG. 3 illustrates one possible example of constructing directional coupler 44 on MMIC 30. In the illustrated example, the directional coupler is a single-section directional coupler, but other ways of constructing directional coupler 44 may be used depending on desired coupler characteristics, such as a coupling ratio, coupling flatness (i.e., a flatness of a coupling response over frequency), directivity, and so on. As an example, a directional coupler can be a multi-section coupler, which may help to increase the coupler bandwidth and flatten out the frequency response. Further, the multi-section coupler may be symmetric or asymmetric.

As shown, directional coupler 44 has an input port P74, an output port P76, a coupled port P78 and an isolated port P80. As noted above, signal power incident upon input port P74 along the main line is partially coupled to coupled port P78 and appears as RF coupled signal 58. The amount of coupled signal power will depend on a particular coupling ratio for which directional coupler 44 is optimized. Isolated port P80 is terminated in a load impedance (e.g., purely resistive or complex), such as R82, that may absorb and dissipate reflected RF energy when, for instance, an open or short condition occurs at the main line output port (i.e., output port P76). Further, directional coupler 44 may be realized using microstrip transmission lines.

RF coupled signal 58 provided out of directional coupler 44 then passes (via C72) to matching circuit 48. In the particular example of FIG. 3, matching circuit 48 comprises a shunt capacitor C84 in combination with a transmission line portion 114. However, those familiar with RF impedance matching techniques will recognize that a given matching circuit may take various forms and will depend on the specific input impedance characteristics of detector circuit 50.

In FIG. 3, C84 is preferably a lumped element (i.e., an element having a small physical size compared to a wavelength at a given operating frequency), where C84 in combination with transmission line portion 114 forms a semi-lumped matching circuit providing a broadband impedance match (i.e., impedance match over a wide frequency range) for detector circuit 50. Advantageously, this may result in achieving a high-sensitivity detector circuit. Further, because the matching circuit is semi-lumped (rather than, for example, implemented using only transmission line elements), compact-sized matching circuit may be realized.

In the example embodiment of FIG. 3, detector circuit 50 comprises a Schottky diode 85, capacitors C86-C90, a line 92, an inductor L94, and a resistor R96. Further, the output of the detector circuit may be coupled via connection 52 (e.g., a piece of transmission line) to RF filtering network 54 including an inductor L98 and a shunt capacitor C100.

As generally known, a Schottky diode, such as diode 85, transforms input RF power into an output voltage that is directly proportional to the input RF power. This type of diode is often used for power detection, AM (amplitude-modulated) demodulation, and so on. In particular, a typical Schottky diode detector follows a so-called "square law" over a given range of input power, where the diode output voltage is directly proportional to the square of the RF signal amplitude. Thus, the output voltage of the diode may be directly used to measure the RF input power. One useful diode characteristic is the voltage sensitivity that describes the ratio of detector output voltage to the applied input signal power (e.g., 1 mV/mW).

Typically, the RF power level into the diode is optimized such that the diode stays within the square law (linear) region. Thus, based on the expected power level range of RF input signal 56, a coupling of directional coupler 44 may be designed accordingly to ensure that the power of RF coupled signal 58 fed into the diode is at a suitable level. Further, directional coupler 44 is preferably optimized to have a substantially flat coupling response over a desired frequency range so that the input power level into the diode stays relatively constant over frequency for an accurate power measurement.

The shunt capacitors C86 and C88 in combination with line 92 form an RF/DC ground path for Schottky diode 85 so that an RF/DC current can flow through the diode. More specifically, C86 and C88 are RF bypass caps, where an RF bypass capacitor acts as an RF short at a frequency of interest, thus providing a signal path to ground. Further, in a preferred embodiment, line 92 is formed using approximately a quarter-wavelength long, high-impedance transmission line that acts as an open circuit at RF, while providing a DC connection to ground. Line 92 may be formed from a microstrip, with the width of the line optimized for high-impedance based on a given thickness and dielectric constant of the microstrip substrate.

Further, C90 and L94 create an RF filtering portion on the output of detector circuit 50. Namely, L94 acts as an RF choke with respect to RF signals, while C90 is a shunt RF bypass capacitor providing a low-impedance path to ground at RF. This way, a possible RF signal leakage or coupling can be decoupled to ground to filter RF signal energy from appearing at an output 102 of detector circuit. Following the RF filtering portion is R96 that provides a load resistance for the detector circuit. Its value may be selected to not overload the output of the diode. Further, although in FIG. 3 the diode is shown as a zero-bias diode, it may also be possible to include an additional diode bias circuit.

As noted above, the output of detector circuit 50 may be coupled via connection 52 (e.g., a piece of transmission line) to RF filtering network 54 including inductor L98 and shunt capacitor C100. Within RF filtering network 54, L98 acts as an RF choke with respect to RF signals, while providing a short circuit at DC. In turn, C100 functions as a shunt RF bypass capacitor providing a low-impedance path to ground at RF and an open circuit at DC. As such, RF filtering network will allow a coupling of the DC voltage present at output 102 to RF input port 32, while blocking the flow of RF input signal 56 to IF/DC output port 38. Advantageously, the output voltage of the detector circuit may be sensed via RF input port 32.

Lastly, 3-dB power divider 40, as shown in FIG. 3, includes a Lange coupler having an input port P104, a first coupled port P106, a second coupled port P108, and an isolated port P110 terminated in a load impedance (e.g., purely resistive or complex, as appropriate), such as a resistor R112.

Generally, a Lange coupler may be constructed from several quarter-wave long coupled transmission lines, typically further bonded together for a tighter 3 dB coupling. As described above, RF input signal 56 will substantially pass via directional coupler 44 and will appear at input port 102. The Lange coupler will divide the RF input signal into two RF output signals 60 and 62 at respective ports 106 and 108, where the two RF output signals have substantially equal power levels (i.e., approximately 3 dB down (e.g., 3+/−0.25 dB down) from the power level of RF input signal 56 at input port 104) and an approximately 90-degree phase difference with respect to each other over a given frequency range. (Note that, if desired, an additional phase-shifting element may be included on MMIC 30 or within a system external to the MMIC to bring the two RF output signals in phase).

A Lange coupler is a preferred way of realizing the 3-dB power divider, but other 3-dB couplers, such as a branchline coupler or ring coupler, and/or other power-dividing structure (s) may be alternately used. One advantage of using a Lange coupler over other structures (e.g., a branchline coupler) is that it may be easier to achieve a desired broadband flat coupling response over a wide frequency range, particularly within millimeter and/or microwave frequency band. Further, at microwave and millimeter-wave frequencies, the quarter-wave length of transmission lines may not be significant such that a MMIC chip having a small die size may be realized.

Figure 4:
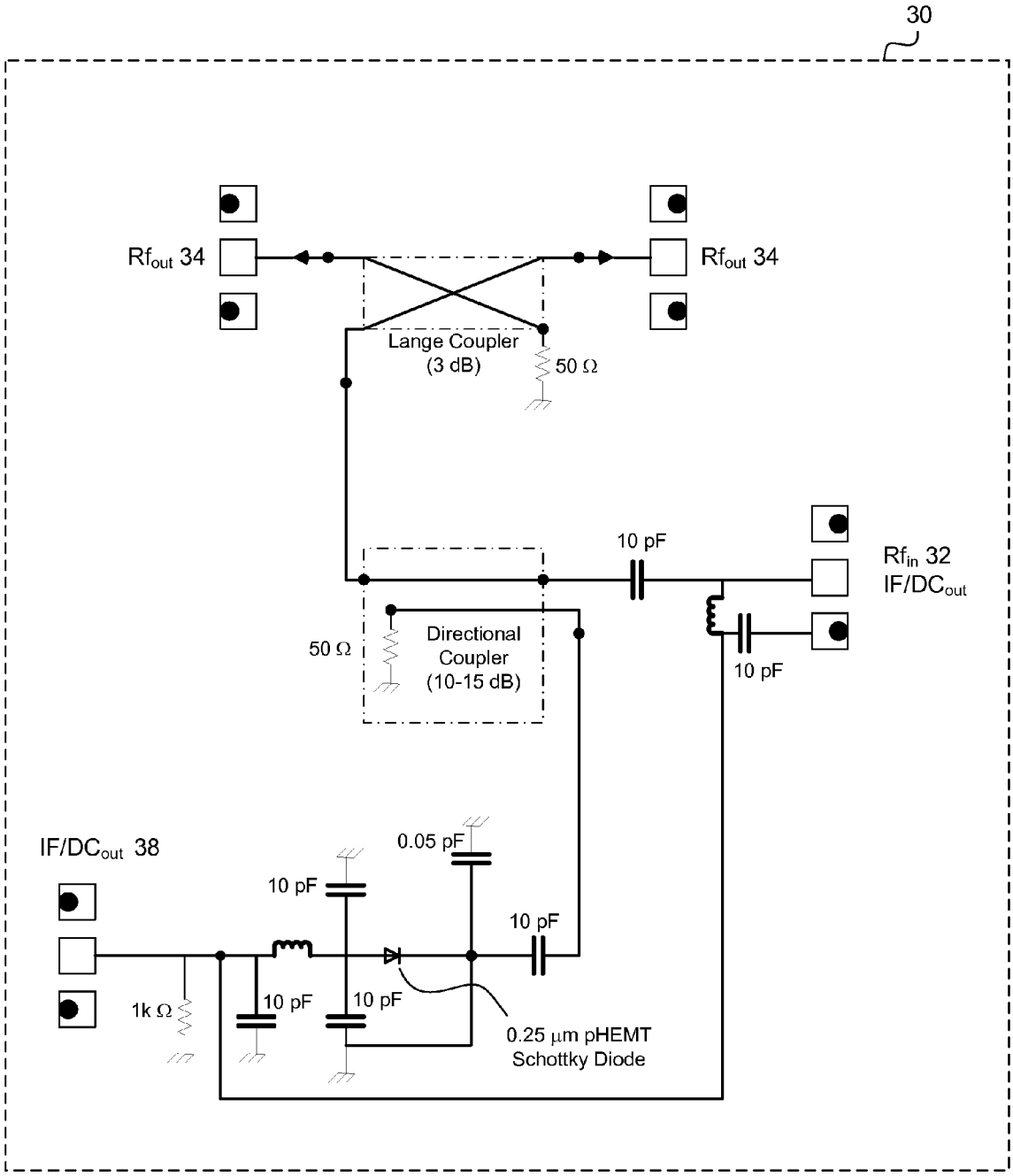
FIG. 4 is a circuit diagram of the representative MMIC according to one particular embodiment.

In a preferred embodiment, MMIC 30 is adapted for broadband high-frequency operation, particularly within microwave and millimeter-wave regions of the RF spectrum. As an example, FIG. 4 illustrates a more detailed circuit diagram of MMIC 30 adapted for operation within approximately 14-20 GHz (or higher) range and optimized at around 18 GHz (hereinafter referred to as "the 18 GHz design"). Note that particular values for RF chokes L94 and L98 are not shown and are typically not critical. Further, as a general rule, a DC blocking capacitor may typically be selected to be equal to an RF bypass capacitor (as in the design shown in FIG. 4) or smaller at a particular frequency of interest.

Additionally, it should be understood that FIG. 4 illustrates sample design values for an operation at a specific frequency range, but MMIC 30 may be optimized for a different frequency range as desired. Various commercially available circuit and layout simulation tools (e.g., Agilent EEsof and others) may be readily used to facilitate MMIC design.

In practice, MMIC 30 may be fabricated on a GaAs-based substrate as is presently typical in the MMIC fabrication process. GaAs is appropriate because of its ability to provide good performance characteristics at high frequencies. Further, it also has a high-resistivity semi-insulating property that can reduce cross talk between on-chip devices and is thus desirable for monolithically formed circuits. In particular, this property of GaAs permits the integration of various types of devices, such as active (radio-frequency) devices, control (logic) devices, and transmission lines and passive elements on a single substrate.

Preferably, MMIC 30 is fabricated using a pHEMT-based process, such the one offered by Triquint Foundry services. However, a standard MESFET-based process or HEMT-based process may also be appropriate in some cases.

In general, the basic principles of operation of a pHEMT/HEMT are very similar to those of a MESFET. The main differences between pHEMT and MESFET structures are primarily related to the composition of the epitaxial layer of a wafer. As such, a pHEMT-based process is typically superior to a MESFET-based process for high-power low-noise applications, particularly at millimeter-wave frequencies. However, a MESFET-based process may also be used through higher-frequency microwave range (e.g., 25 GHz), and sometimes even into the millimeter-wave frequency range.

In one example, MMIC 30 (e.g., the 18 GHz design shown in FIG. 4) may be fabricated using Triquint 0.25 μm 2 MI (2-metal-interconnect) pHEMT process suitable for applications up to 50 GHz (e.g., various communication, space, and military applications), where 0.25 μm refers to a gate length of a basic transistor structure used in the fabrication process.

More particularly, in a typical FET having gate, source, and drain terminals, the source and drain are connected to a channel with ohmic metal contacts that form low-resistance connections to these terminals. On the other hand, the gate connection to the channel is formed between the drain and source by a Schottky metal contact. Some common parameters associated with a FET structure include a gate finger, a gate length and a gate width.

A gate finger refers to a single gate structure. Most FETs have multiple gate fingers that can be electrically connected together through a so-called gate bus-bar. The total size of FET (or periphery) is then the number of gate fingers times the unit gate width. A gate length is the shorter dimension of a gate finger and has a significant effect on the maximum frequency of operation. For example, quarter-micron gates are typically suitable in a Ka-band (roughly a 18-30/40 GHz range).

Further, a gate width (or the longer dimension of a gate finger) refers to the unit width of the gate as it passes between the source and drain terminals across the semiconducting area of a FET. Gate width must typically be sized appropriate to the operating frequency. Typically, if the gate width becomes an appreciable fraction of a wavelength at frequencies of interest, the RF performance of the FET may suffer. For example, in a Ka band, the gate width is typically 0.75 μm maximum.

Figure 5:
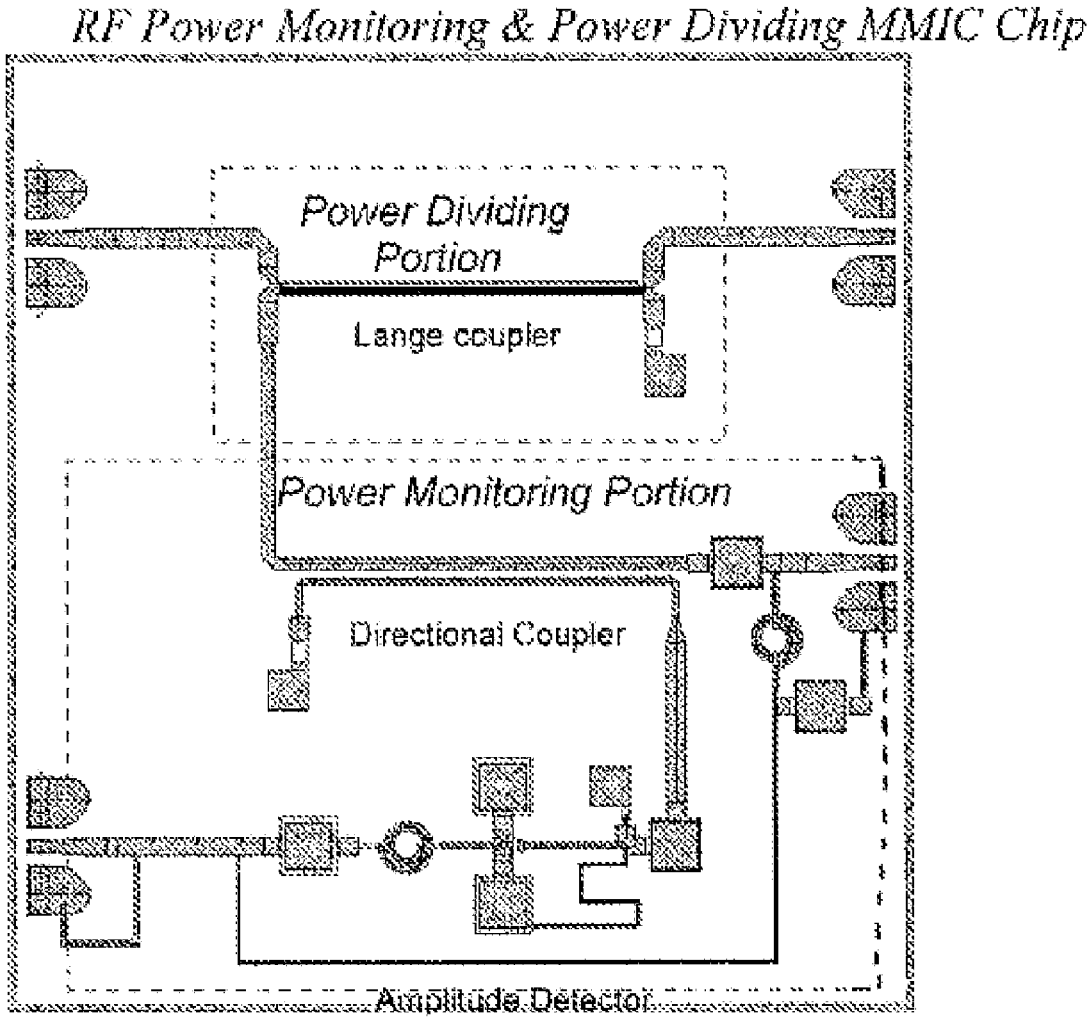
FIG. 5 is an example of a chip layout of the representative MMIC.

The example 0.25 μm 2 MI pHEMT process from Triquint may be used for fabrication of transistors, diodes, variety of passive elements (e.g., couplers (including Lange and directional couplers), capacitors, resistors, air bridges, transmission lines, substrate vias, etc.) up to 50 GHz. FIG. 5 illustrates an example chip layout of the 18 GHz MMIC design shown in FIG. 4 that may be developed using this particular process.

In general, various circuit components included on MMIC 30 may be fabricated as lumped elements in a variety of different forms to make the overall circuit compact. For example, resistors may be metal thin-film resistors, ion-implemented resistors, or GaAs-based resistors implemented using a FET channel and ohmic contacts already available in the basic pHEMT fabrication process. Capacitors may be provided in the form of interdigitated (or "interdigital") capacitors, metal-insulator-metal (MIM) capacitors, or others. Further, lumped inductors (or coils) are typically fabricated as spiral inductors (i.e., narrow transmission lines in a spiral shape), although loop inductors are also common. For example, in the chip layout shown in FIG. 5, L94 and L98 are both implemented as spiral inductors.

Further, Schottky diode 85 can be implemented in many different ways, such as by shorting gate and source contacts of a basic FET structure already available in the basic pHEMT fabrication process or forming dedicated Schottky/ohmic finger(s) for the diode. Typically, a Schottky diode will exhibit a number of parasitic parameters, including a junction resistance, a junction capacitance, and a series resistance. The diode cutoff frequency, which should be much higher than the frequency at which the diode is operated as a detector, depends on the value of the series resistance and junction capacitance. Further, the series resistance and the junction capacitance reduce voltage sensitivity of the diode detector over frequency.

Thus, it may be desirable to minimize these parasitics. One method of reducing these parasitics includes interdigitating fingers of the ohmic and Schottky contacts of the diode to increase the diode area. For example, in FIG. 5, Schottky diode may be formed using two 0.75 μm-wide fingers.

Advantageously, the illustrative 18 GHz chip design of MMIC 30 fabricated using the preferred 0.25 μm 2 MI pHEMT process from Triquint may provide the following key features:

(i) Broadband operation (e.g., 14-20 GHz or more)

(ii) High sensitivity (e.g., 10 mV/mW) and a large dynamic range (i.e., a range of input power over which the detector circuit stays linear) (e.g., 25-30 dB)

(iii) Low RF input power requirements for the detector circuit (e.g., −20 dBm)

(iv) High DC and IF detector outputs (~300 mV @ RF input of 16 dBm, in the 16-20 GHz frequency range)

(v) RF Input and IF/DC output provided at the same port to reduce the number of connectors used for packaging the chip (vi)Compact size (approximately 3 mm×2.5 mm).

When fabricated, MMIC 30 may be provided in a bare-die chip form and/or may be packaged in a variety of different forms. As one example, the MMIC chip may be attached (e.g., following the fabrication process or at a later time) to a carrier material, such as a ceramic substrate and a metal base plate, and bonded using wire bonds, ribbon bonds, or flip-chip technology into a larger RF system. Further, by providing the capability to monitor IF/DC output at RF input port 32 (e.g., by connecting externally a circuit suitable for sensing DC voltages present on the RF input), a number of external bond connections to MMIC 30 may be reduced when connecting the MMIC into a larger RF system, for instance.

3. Example Application

As discussed earlier, the need for power dividing and power monitoring functions may exist in a variety of systems, such as radar systems. In one example application, MMIC 30 may be incorporated into a phase-ranging radar system that measures the change in the phase of a reflected-from-target signal to determine a range to the target.

More particularly, RF output signal 60 or 62 may be used as a reference signal, while the other RF output signal may be transmitted toward the target. The reference signal and the signal reflected from the target may be subsequently fed into a phase comparator/mixer to determine the difference in phase between the reference signal and the reflected signal. Based on that difference, the range of the target may be calculated. Further, RF power monitoring capability of MMIC 30 may be used to concurrently control the output power of the RF output signals.

4. Conclusion

While particular embodiments have been described, persons of skill in the art will appreciate that variations may be made without departure from the scope and spirit of the invention. This true scope and spirit is defined by the appended claims, which may be interpreted in light of the foregoing. Further, the examples in the above description and figures are set forth in the context of a MMIC, but the disclosed monolithic integrated circuit could be adapted for operation within other frequency bands and not only those described in the above examples.

I claim:

1. A circuit comprising:

a power dividing portion for dividing an RF signal power; and a power monitoring portion for monitoring the RF signal power, wherein the power monitoring portion includes a directional coupler and a detector circuit, wherein the detector circuit includes a semi lumped broadband matching circuit; and wherein the power monitoring portion and the power dividing portion are integrated monolithically.

2. The circuit of claim 1, wherein the circuit is a microwave monolithic integrated circuit (MMIC).

3. The circuit of claim 2, wherein the MMIC is fabricated on a single semiconductor chip.

4. The circuit of claim 2, wherein the MMIC is fabricated using a pHEMT-based process.

5. The circuit of claim 2, wherein the MMIC is operable within a microwave or millimeter-wave frequency band.

6. The circuit of claim 1, wherein the power dividing portion includes a power divider selected from the group consisting of (i) a Lange coupler, (ii) a branchline coupler, and (iii) a ring coupler.

7. The circuit of claim 5, wherein the MMIC operates within a frequency range of approximately 14-20 GHz.

8. The circuit of claim 1, wherein the detector circuit includes a Schottky diode.

9. The circuit of claim 1, wherein the power dividing portion divides the RF signal power substantially in half.

10. A circuit comprising:

an RF input port;

a power monitoring portion coupled to the RF input port, wherein the power monitoring portion receives an RF input signal applied to RF input port, and wherein the power monitoring portion produces an output voltage representative of power of the RF input signal;

a power dividing portion coupled to the power monitoring section, wherein the power dividing portion divides the RF signal into at least a first RF output signal and a second RF output signal; and at least two RF output ports, wherein the first RF output signal is provided at a first RF output port and the second RF signal is provided at a second RF output port, wherein the circuit is formed as a monolithic integrated circuit.

11. The circuit of claim 10, further comprising:

a power-monitoring output port, wherein the output voltage is present at power-monitoring output port.

12. The circuit of claim 10, wherein the RF signal is a continuous wave (CW) RF signal or a modulated RF signal.

13. The circuit of claim 10, wherein the circuit is a microwave monolithic integrated circuit (MMIC).

14. The circuit of claim 13, wherein the MMIC is a single-chip MMIC.

15. The circuit of claim 14, wherein the single-chip MMIC is fabricated using a pHEMT-based process.

16. The circuit of claim 10, wherein the output voltage is coupled to the RF input port.

17. The circuit of claim 16, wherein the output voltage is sensed via the RF input port.

18. The circuit of claim 16, wherein the output voltage is coupled to the RF input port via an RF filtering network.

* * * * *